US009224330B2

(12) United States Patent
Park et al.

(10) Patent No.: US 9,224,330 B2
(45) Date of Patent: Dec. 29, 2015

(54) DISPLAY DEVICE FOR REDUCING DYNAMIC FALSE CONTOUR

(71) Applicant: Samsung Display Co., Ltd., Yongin, Gyeonggi-Do (KR)

(72) Inventors: Jin-Woo Park, Yongin (KR); Sang-Jin Pak, Yongin (KR); Ji-Gong Lee, Yongin (KR); Sang-Kwon Ha, Yongin (KR); Su-min Yang, Yongin (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 0 days.

(21) Appl. No.: 14/161,147

(22) Filed: Jan. 22, 2014

(65) Prior Publication Data

US 2014/0313245 A1 Oct. 23, 2014

(30) Foreign Application Priority Data

Apr. 17, 2013 (KR) ..... 10-2013-0042360

(51) Int. Cl.
*G09G 5/10* (2006.01)
*G09G 3/32* (2006.01)
*G09G 3/20* (2006.01)

(52) U.S. Cl.
CPC ..... *G09G 3/3225* (2013.01); *G09G 3/2033* (2013.01); *G09G 2320/0266* (2013.01)

(58) Field of Classification Search
CPC ..... G09G 2320/0261; G09G 3/2022; G09G 2320/0266; G09G 2320/0276; G09G 2320/0247; G09G 2360/16; G09G 3/2003; G09G 3/28; G09G 3/3648; G09G 2310/0235; G09G 2320/0238; G09G 3/2927; G09G 3/2029; G09G 3/204; G09G 2310/066; G09G 3/2803; G09G 2320/0242; G09G 3/2033; G09G 3/344; G09G 2310/024; G09G 2310/061; G09G 2320/0285; G09G 2320/0626; G09G 2340/06; G09G 3/2018; G09G 3/2081; G02F 1/1323; G02F 1/13306; G02F 1/141
USPC ..... 345/76–82, 690, 204, 211, 694, 691, 345/87, 89, 98, 99, 100, 60, 61, 62, 63
See application file for complete search history.

(56) References Cited

U.S. PATENT DOCUMENTS 6,147,792 A * 11/2000 Jones et al. ..... 359/320
6,380,688 B1 * 4/2002 Bae et al. ..... 315/169.3

(Continued)

FOREIGN PATENT DOCUMENTS

KR 1020050104648 11/2005
KR 1020080112631 12/2008
KR 100926635 11/2009

(Continued)

*Primary Examiner* — Duc Dinh
(74) *Attorney, Agent, or Firm* — Robert E. Bushnell, Esq.

(57) ABSTRACT

A display device includes a display panel and a timing controller. The display panel includes a plurality of pixels, and the timing controller determines a driving method that includes a first sub-frame arrangement method and a second sub-frame arrangement method. An arrangement of weight values of a plurality of sub-frames of the second sub-frame arrangement method is given in an opposite order from an arrangement of weight values of a plurality of sub-frames of the first sub-frame arrangement method. The timing controller applies the first sub-frame arrangement method to a first pixel among the pixels, and applies the second sub-frame arrangement method to a second pixel that is disposed next to the first pixel.

8 Claims, 14 Drawing Sheets

(56) References Cited

U.S. PATENT DOCUMENTS

| | | | | |
|---|---|---|---|---|
| 8,373,625 | B2 * | 2/2013 | Kimura | 345/77 |
| 2004/0239694 | A1 * | 12/2004 | Takeda et al. | 345/690 |
| 2008/0111837 | A1 * | 5/2008 | Kim et al. | 345/690 |
| 2012/0293564 | A1 * | 11/2012 | Kajiyama et al. | 345/690 |

FOREIGN PATENT DOCUMENTS

| | | |
|---|---|---|
| KR | 1020100119747 | 7/2012 |

* cited by examiner

FIG. 3

| SF | SF1 | SF2 | SF3 | SF4 | SF5 | SF6 | SF7-1 | SF7-2 | SF8-1 | SF8-2 | SF8-3 | SF8-4 |
|---|---|---|---|---|---|---|---|---|---|---|---|---|
| TIME | 1 | 2 | 4 | 8 | 16 | 32 | 32 | 32 | 32 | 32 | 32 | 32 |

FIG. 7

First driving method

| SF | SF1 | SF2 | SF3 | SF4 | SF5 | SF6 | SF7-1 | SF7-2 | SF8-1 | SF8-2 | SF8-3 | SF8-4 |
|---|---|---|---|---|---|---|---|---|---|---|---|---|
| TIME | 1 | 2 | 4 | 8 | 16 | 32 | 32 | 32 | 32 | 32 | 32 | 32 |

FIG. 8

Second driving method

| SF | SF8-4 | SF8-3 | SF8-2 | SF8-1 | SF7-2 | SF7-1 | SF6 | SF5 | SF4 | SF3 | SF2 | SF1 |
|---|---|---|---|---|---|---|---|---|---|---|---|---|
| TIME | 32 | 32 | 32 | 32 | 32 | 32 | 32 | 16 | 8 | 4 | 2 | 1 |

DISPLAY DEVICE FOR REDUCING DYNAMIC FALSE CONTOUR

CLAIM OF PRIORITY

This application claims priority to and the benefit of Korean Patent Application No. 10-2013-0042360 filed in the Korean Intellectual Property Office on Apr. 17, 2013, the entire contents of which are incorporated herein by reference.

BACKGROUND OF THE INVENTION

1. Field of the Invention

Embodiments of the present invention relates to a display device for reducing a false contour, and a driving method thereof. More particularly, the present invention relates to a display device for reducing a dynamic false contour and improving image quality, and a driving method thereof.

2. Description of the Related Art

Various kinds of flat display devices that are capable of reducing detriments of cathode ray tubes (CRT), such as their heavy weight and large size, have been developed in recent years. Such flat display devices include liquid crystal displays (LCDs), field emission displays (FEDs), plasma display panels (PDPs), and organic light emitting diode (OLED) displays.

Among the above flat panel displays, the organic light emitting diode display using an organic light emitting diode (OLED) generating light by a recombination of electrons and holes for the display of images has a fast response speed, is simultaneously driven with low power consumption, and had excellent luminous efficiency, luminance, and viewing angle such that it has been spotlighted.

In general, a plurality of pixels emitting light in the organic light emitting diode display include an organic light emitting diode, and the organic light emitting diode generates light of a predetermined luminance corresponding to a data current supplied from a pixel circuit.

Digital driving which is one of gray expression methods of the organic light emitting diode display controls an on time of a pixel. In the case of the organic light emitting diode display that follows the digital driving method, one frame is divided into a plurality of sub-frames, and a light emitting period of each sub-frame is appropriately set in order to display a gray. The pixel emits light during a sub-frame selected depending on an image signal for gray expression among the plurality of sub-frames constituting one frame. That is, the sub-frame selected according to the image signal is turned on to express the grayscale.

However, according to the digital driving (sub-frame mode), in a case where a motion picture is played, or the observer's eye to observe still images is moved, light of the previous frame and the current frame between the adjacent pixels is overlapped and observed by the observer's eye. Then, bright or dark grayscales, which are not desired grayscales for representation, are displayed. This is called a dynamic false contour phenomenon.

Recently, a method for weakening intensity of the dynamic false contour phenomenon by increasing a number of sub-frames has been adapted for the purpose of improving the dynamic false contour phenomenon, but the method requires a higher driving frequency so it has a restriction in application. Further, additional image processing such as dithering or error diffusion has been used to improve the dynamic false contour phenomenon, which is, however, difficult to integrate into a drive IC of medium to small displays. Therefore, studies for improving the problem of failing to express desired grayscales because of the dynamic false contour phenomenon are needed.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to express a grayscale to be most similar to a grayscale of an original image by minimizing generation of a dynamic false contour phenomenon.

The technical objects of the present invention are not limited to the above, and other non-mentioned objects will be clearly understood by a person of ordinary skill in the art by way of the following description.

An exemplary embodiment of the present invention provides a display device including: a display panel including a plurality of pixels; and a timing controller for determining a driving method, wherein the driving method includes a first sub-frame arrangement method and a second sub-frame arrangement method of which arrangements of weight values of a plurality of sub-frames are given in an opposite order from an arrangement of weight values of a plurality of sub-frames of the first sub-frame arrangement method, and the timing controller applies the first sub-frame arrangement method to a first pixel among the pixels and applies the second sub-frame arrangement method to a second pixel that is adjacent to the first pixel as the second sub-frame arrangement method.

The timing controller sets a driving method of a second pixel as the first sub-frame arrangement method and a driving method of a third pixel that is adjacent to the second pixel as the first sub-frame arrangement method.

The timing controller sets a driving method of the first pixel of a predetermined frame as the first sub-frame arrangement method and a driving method of the first pixel of a frame that is next to the predetermined frame as the second sub-frame arrangement method, and the timing controller sets a driving method of the first pixel of a predetermined frame as the second sub-frame arrangement method and a driving method of the first pixel of a frame that is nest to the predetermined frame as the first sub-frame arrangement method.

The first sub-frame arrangement method is a sequential arrangement of sub-frames having weight values of a grayscale of 1, a grayscale of 2, a grayscale of 4, a grayscale of 8, a grayscale of 16, and a multiple grayscales of 32, and the second sub-frame arrangement method is a sequential arrangement of sub-frames having weight values of a multiple grayscales of 32, the grayscale of 16, the grayscale of 8, the grayscale of 4, the grayscale of 2, and the grayscale of 1.

Another embodiment of the present invention provides a display device including: a scan driver for transmitting a plurality of scan signals to a plurality of scan lines; a data driver for transmitting a plurality of data signals to a plurality of data lines; a display panel including a plurality of pixels; and a timing controller for controlling the scan driver and determining a driving method applicable to a plurality of pixels connected to a predetermined scan line among the plurality of scan lines, wherein the driving method includes a first sub-frame arrangement method and a second sub-frame arrangement method of which arrangements of weight values of a plurality of sub-frames are given in an opposite order, the timing controller sets the first sub-frame arrangement method to a first scan line among the scan lines and the second sub-frame arrangement method to a second scan line that is next to the first scan line, the plurality of pixels include a switching transistor including a gate electrode connected to a corresponding scan line among the plurality of scan lines and a source electrode connected to a corresponding data line among a plurality of data lines, and when the switching transistor included by a first pixel from among the plurality of pixels is connected to a first scan line from among the plurality of scan lines, the switching transistor included by a second pixel that is adjacent to the first pixel is connected to a second scan line that is adjacent to the predetermined scan line.

The timing controller sets a driving method of the first pixel of a predetermined frame as the first sub-frame arrangement method and a driving method of the first pixel of a frame that is next to the predetermined frame as the second sub-frame arrangement method, and the timing controller sets a driving method of the first pixel of a predetermined frame as the second sub-frame arrangement method and a driving method of the first pixel of a frame that is nest to the predetermined frame as the first sub-frame arrangement method.

The first sub-frame arrangement method is a sequential arrangement of sub-frames having weight values of a grayscale 1, a grayscale 2, a grayscale 4, a grayscale 8, a grayscale 16, and n-numbered (n is a natural number that is greater than one) grayscales 32, and the second sub-frame arrangement method is a sequential arrangement of sub-frames having weight values of the n-numbered (n is a natural number that is greater than one) grayscales 32, the grayscale 16, the grayscale 8, the grayscale 4, the grayscale 2, and the grayscale 1.

The plurality of pixels include: a pixel driver including the switching transistor, a driving transistor, and a storage capacitor; and an organic light emitting diode (OLED), wherein positions of the pixel driver and the organic light emitting diode (OLED) among adjacent pixels from among the plurality of pixel are reversed.

According to the embodiment of the present invention, the display device minimizes generation of the false contour phenomenon to express the grayscale to be the most similar to the grayscale of the original image.

BRIEF DESCRIPTION OF THE DRAWINGS

FIG. 3 shows a sub-frame configuring one frame of a conventional digital driving method.

FIG. 7 shows a sub-frame configuring one frame in a display device according to an exemplary embodiment of the present invention, that is, an example of a driving method.

FIG. 8 shows a sub-frame configuring one frame in a display device according to an exemplary embodiment of the present invention, that is, an example of a driving method.

DETAILED DESCRIPTION OF THE EMBODIMENTS

Figure 1:
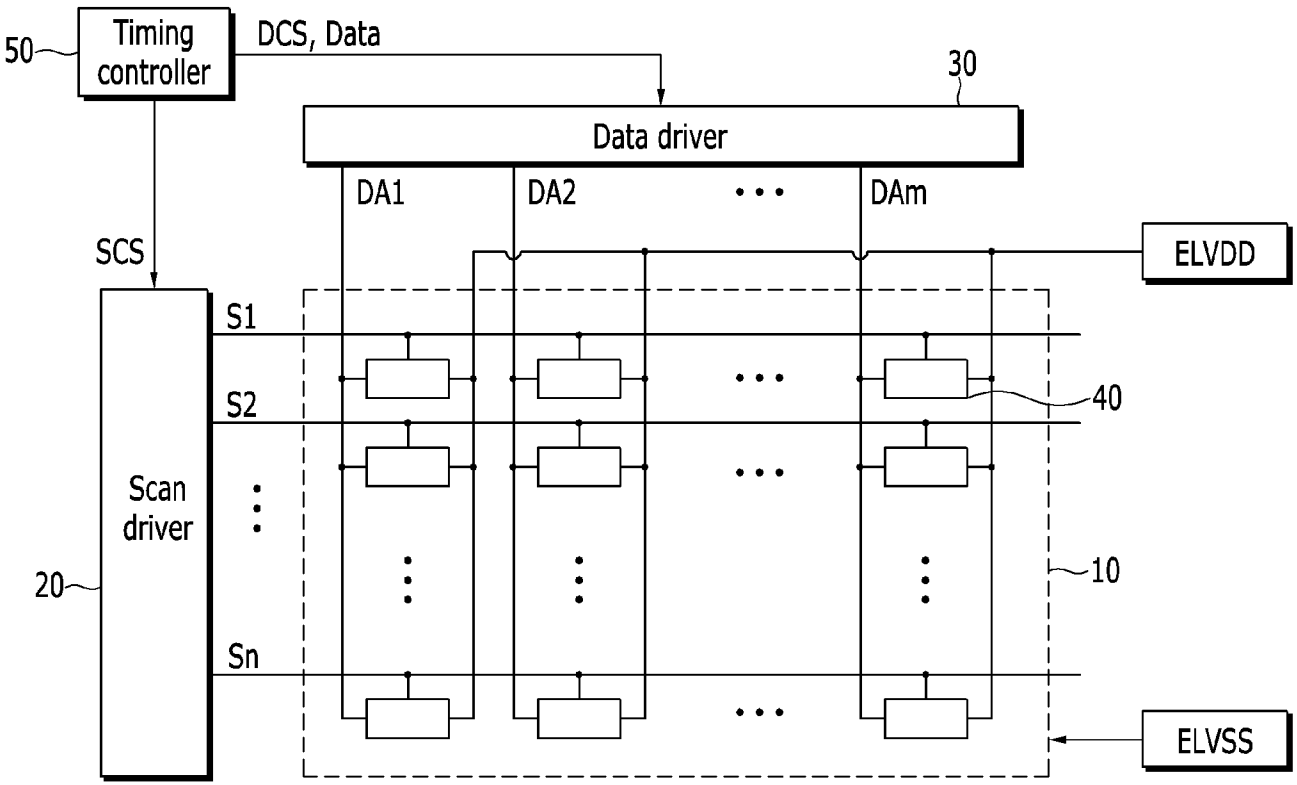
FIG. 1 shows a block diagram of a display device according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In the several exemplary embodiments, constituent elements having the same configuration are representatively described in a first exemplary embodiment by designating like constituent elements thereto, and other exemplary embodiments will be described only regarding differences from the first exemplary embodiment.

The drawings and description are to be regarded as illustrative in nature and not restrictive, and like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 shows a block diagram of a display device according to an exemplary embodiment of the present invention.

Referring to FIG. 1, the display device includes a display panel 10 including a plurality of pixels 40 connected to scan lines S1 to Sn and data lines DA1-DAm, a scan driver 20 for supplying a scan signal to the scan lines S1 to Sn and driving the scan lines, a data driver 30 for supplying a data signal to the data lines DA1-DAm and driving the data lines, and a timing controller 50 for controlling the scan driver 20 and the data driver 30.

The timing controller 50 generates a data driving control signal (DCS) and a scan driving control signal (SCS) corresponding to a synchronization signal that is externally supplied. The data driving control signal (DCS) generated by the timing controller 50 is supplied to the data driver 30, and the scan driving control signal (SCS) is supplied to the scan driver 20.

The timing controller 50 converts the image signal that is externally supplied into an image data signal Data and supplies it to the data driver 30.

The data driver 30 supplies a plurality of data signals to a plurality of data lines DA1-DAm for each group of a plurality of sub-frames (SF) included in one frame according to the data driving control signal (DCS).

In detail, the data driver 30 is synchronized with a time when the scan signal having a gate-on voltage corresponding to each sub-frame and transmits a plurality of data signals for controlling emission states of a plurality of pixels 40 through a plurality of data lines DA1-DAm. The gate-on voltage represents a level for turning on a switching transistor so that the data signal may be transmitted to a gate electrode of the driving transistor for transmitting a driving current to the organic light emitting diode (OLED), which will be described in detail with reference to a configuration of a pixel shown in FIG. 2.

The scan driver 20 is synchronized with a starting point of each sub-frame, and supplies the scan signal with a gate-on voltage to the corresponding scan line from among the scan lines S1-Sn. Therefore, a plurality of pixels 40 connected to the scan line to which the scan signal with a gate-on voltage is supplied from among the scan lines S1-Sn are selected. The pixels 40 selected by the scan signal receive the data signal from the data lines DA1-DAm according to the corresponding sub-frame. In this instance, the corresponding sub-frame signifies a sub-frame that corresponds to the scan signal with a gate-on voltage.

A first power ELVDD and a second power ELVSS supply two driving voltages for operating the pixels 40. The two driving voltages includes a high-level first driving voltage supplied as the first power ELVDD and a low-level second driving voltage supplied from the second power ELVSS.

A configuration of a pixel circuit of a display device of FIG. 1 will now be described with reference to a circuit diagram shown in FIG. 2.

Figure 2:
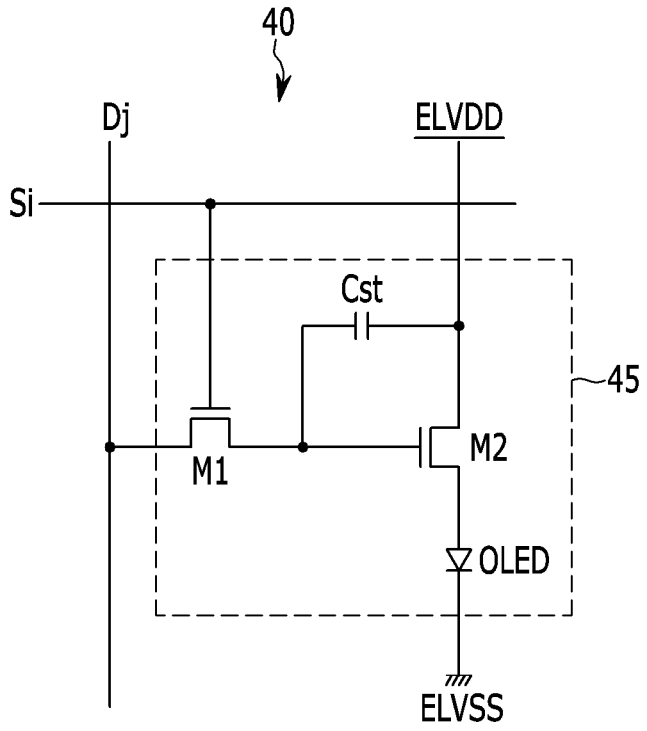
FIG. 2 shows a circuit diagram of a pixel circuit of a display device of FIG. 1.

FIG. 2 shows a pixel circuit 45 of a pixel 40 connected to the i-th scan line Si and the j-th data line Dj from among a plurality of pixels in a display device of FIG. 1. Here, and j are given as $1 \leq i \leq n$ and $1 \leq j \leq m$, respectively.

Referring to FIG. 2, the pixel circuit 45 includes a switching transistor M1, a driving transistor M2, a storage capacitor Cst, and an organic light emitting diode OLED. FIG. 2 is one exemplary embodiment of the driving circuit of the pixel, and known configurations of the pixel circuit are applicable in various ways.

In detail, the switching transistor M1 of FIG. 2 includes a gate electrode connected to a corresponding scan line from among a plurality of scan lines, a source electrode connected to a corresponding data line from among a plurality of data lines, and a drain electrode connected to a node to which a first end of the storage capacitor Cst and a gate electrode of the driving transistor M2 are connected.

Further, the driving transistor M2 includes a gate electrode connected to the drain electrode of the switching transistor M1, a source electrode connected to the first power ELVDD, and a drain electrode connected to an anode of the organic light emitting diode OLED.

The storage capacitor includes a first end connected to a node to which the drain electrode of the switching transistor M1 and the gate electrode of the driving transistor M2 are connected, and a second end connected to the source electrode of the driving transistor M2, and maintains a voltage difference between the gate electrode and the source electrode of the driving transistor M2 during the sub-frame period.

The organic light emitting diode OLED includes an anode connected to the drain electrode of the driving transistor M2 and a cathode connected to the second power ELVSS.

When the switching transistor M1 is turned on according to the scan signal transmitted through the scan line, the data signal transmitted through the turned-on switching transistor M1 is transmitted to the gate electrode of the driving transistor M2. Therefore, the voltage difference between the gate electrode and the source electrode of the driving transistor M2 is a difference between the data signal and the first driving voltage of the first power, and a driving current flows to the driving transistor M2 according to the corresponding voltage difference.

The driving current is transmitted to the organic light emitting diode OLED, and the organic light emitting diode OLED emits light according to the transmitted driving current.

When a plurality of scan signals with a gate-on voltage level are supplied to the corresponding scan lines from among a plurality of scan lines S1-Sn, a plurality of switching transistors M1 connected to the corresponding scan lines are turned on. A plurality of data lines DA1-DAm are synchronized with a time when the scan signals with a gate-on voltage are supplied, and they receive the data signal.

The data signal transmitted to the data lines DA1-DAm through the turned-on switching transistors M1 is transmitted to the gate electrode of each driving transistor M2 of the pixels 40, and each organic light emitting diode OLED of the pixels 40 emits light or does not emit it during the corresponding sub-frame period according to the transmitted data signal.

FIG. 3 shows a sub-frame configuring one frame of a conventional digital driving method.

Regarding the sub-frame arrangement shown in FIG. 3, the sub-frames are arranged in an ascending order from a sub-frame 1 (SF1) as a start sub-frame to a sub-frame 8-4 (SF8-4). In other words, the sub-frames are arranged in the order of the sub-frame 1 (SF1), a sub-frame 2 (SF2), a sub-frame 3 (SF3), a sub-frame 4 (SF4), a sub-frame 5 (SF5), a sub-frame 6 (SF6), a sub-frame 7-1 (SF7-1), a sub-frame 7-2 (SF7-2), a sub-frame 8-1 (SF8-1), a sub-frame 8-2 (SF8-2), a sub-frame 8-3 (SF8-3), and the sub-frame 8-4 (SF8-4). Each of the sub-frames is assigned with a light emitting period required for the representation of grayscales, and the light emitting period corresponding to each of the sub-frames is shown in the bottom row of a table of FIG. 3. The number shown in the bottom row of the table of FIG. 3 can be referred to as a weight value of the sub-frame. The weight values of the sub-frames SF1 through SF5 are grayscales of 1, 2, 4, 8 and 16, and each of the sub-frames SF6 through SF8-4 has a weight value of grayscale of 32. These definitions of weight values are also applied to the tables shown in FIGS. 7 and 8.

In such a digital driving mode, one frame is divided into a plurality of sub-frames, and a sub-frame or a combination of sub-frames selected in response to the video signal is turned on during one frame to represent the grayscale. For example, in order to represent the grayscale of 12, the sub-frame 3 (SF3) with four light emitting periods and the sub-frame 4 (SF4) with eight light emitting periods are turned on once during one frame, and in order to represent the grayscale of 127, the sub-frame 1 (SF1) to the sub-frame 7-2 (SF7-2) are turned on during one frame, while in order to represent the grayscale of 128, the sub-frame 8-1 (SF8-1) to the sub-frame 8-4 (SF8-4) are turned on during one frame.

However, when a video is played, or the observer's eye, while observing still images, is moved, a dynamic false contour phenomenon will occur due to visual characteristics of human eyes. That is, since light between the adjacent (or next) pixels is overlapped and provided to the eye of the viewer, the grayscale, which is not desired but is brighter or darker than the desired one, is expressed. This issue will now be described below.

Figure 4:
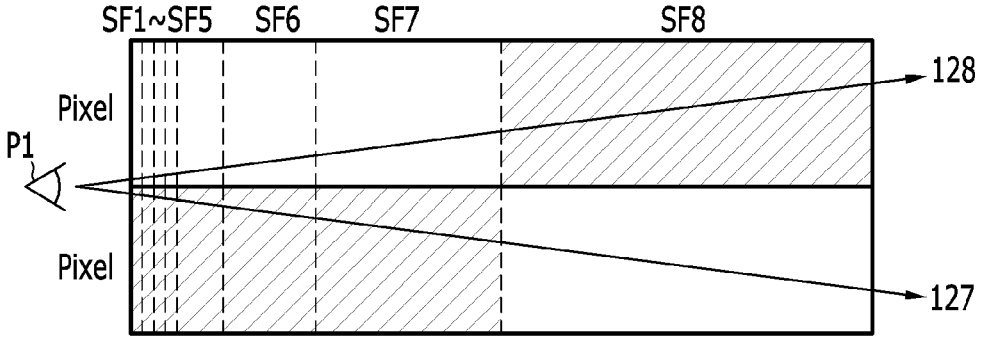
FIG. 4 shows a grayscale viewable by a viewer when one frame is configured with a sub-frame of FIG. 3 and there is a still image.

FIG. 4 shows a grayscale viewable by a viewer when one frame is configured with a sub-frame shown in FIG. 3 and there is a still image.

As shown in FIG. 4, for example, when the gray level of 127 and the gray level of 128 are expressed by an adjacent (or next) pixel and there is a still image, the viewer sees the gray level of 127 and the gray level of 128. In this case, the dynamic false contour phenomenon may not occur. In FIG. 4, the upper pixel has a grayscale of 128, and the hatched area SF8 represents the turned-on sub-frames SF8-1 through SF8-4, as shown in FIG. 3, to achieve the grayscale of 128. The lower pixel has a grayscale of 127, and the hatched area represents the turned-on sub-frame SF1 through SF7-2, as shown in FIG. 3, to achieve the grayscale of 127. The sub-frame SF7 in FIG. 4 represents the sub-frame SF7-1 and SF7-2 shown in FIG. 3. Viewer's eyes are located in the position P1. The reference numeral 127 in FIG. 4 represents the grayscale (or gray level) of 127, and the reference numeral 128 represents the grayscale (or gray level) of 128. The definitions described in this paragraph are also applied to the drawings in FIGS. 5, 6, 10, 11 and 12.

Figure 5:
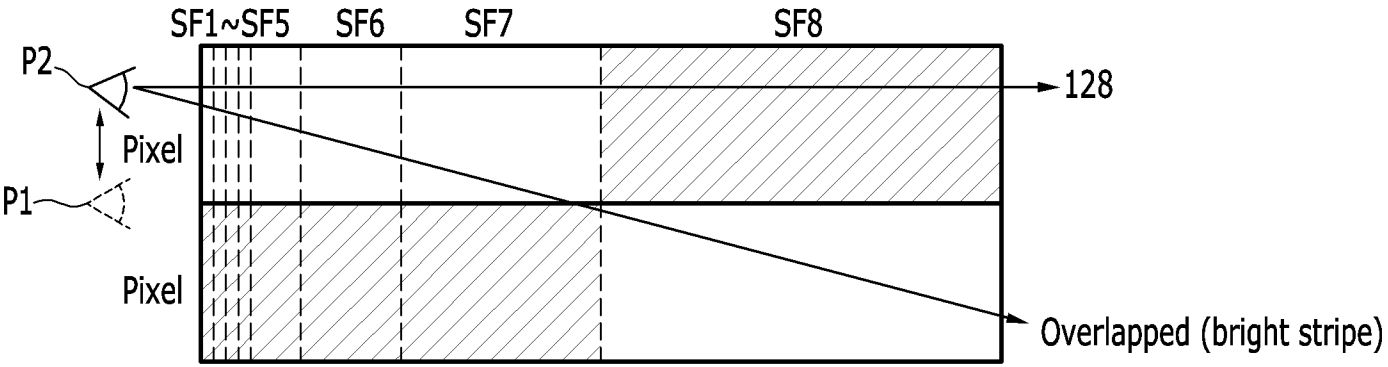
FIG. 5 shows a reason for a dynamic false contour phenomenon by expressing a grayscale viewable by a viewer when one frame is configured with a sub-frame of FIG. 3 and an image moves.

FIG. 5 shows a reason of a dynamic false contour phenomenon by expressing a grayscale viewable by a viewer when one frame is configured with a sub-frame of FIG. 3 and an image moves.

As shown in FIG. 5, for example, when the gray level 127 and the gray level 128 are expressed by an adjacent pixel and the viewer's eye moves from the bottom (position P1) to the top (position P2) with respect to the displaying screen, the pixel for expressing the gray level 128 will express the gray level 128, and the adjacent pixel for expressing the gray level 127 will show a bright stripe because of a relative movement of the viewer's eye. Therefore, in this case, the dynamic false contour phenomenon may occur.

Figure 6:
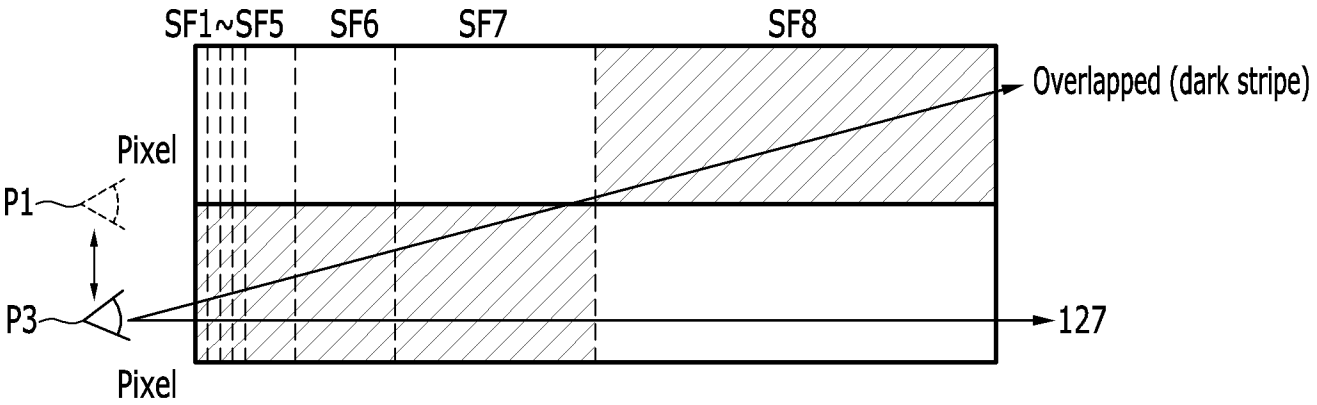
FIG. 6 shows a reason for a dynamic false contour phenomenon by expressing a grayscale viewable by a viewer when one frame is configured with a sub-frame of FIG. 3 and an image moves in an opposite direction of FIG. 5.

FIG. 6 shows a reason for a dynamic false contour phenomenon by expressing a grayscale viewable by a viewer when one frame is configured with a sub-frame of FIG. 3 and an image moves in an opposite direction of FIG. 5.

As shown in FIG. 6, for example, when the gray level 127 and the gray level 128 are expressed by adjacent pixels and the viewer's eye moves from the top (position P1) to the bottom (position P3) with respect to the displaying screen, the pixel for expressing the gray level 127 will express the gray level 127, and the adjacent pixel for expressing the gray level 128 will show a dark stripe because of a relative movement of the viewer's eye. Therefore in this case, the dynamic false contour phenomenon may occur.

FIG. 7 shows a sub-frame configuring one frame in a display device according to an exemplary embodiment of the present invention, that is, an example of a driving method.

The sub-frames according to the first driving method of the embodiment of the present invention shown in FIG. 7 are arranged in an ascending order from the sub-frame 1 (SF1) as a start sub-frame to the sub-frame 8-4 (SF8-4), that is, the sub-frame 1 (SF1), the sub-frame 2 (SF2), the sub-frame 3 (SF3), the sub-frame 4 (SF4), the sub-frame 5 SF5, the sub-frame 6 SF6, the sub-frame 7-1 (SF7-1), the sub-frame 7-2 (SF7-2), the sub-frame 8-1 (SF8-1), the sub-frame 8-2 (SF8-2), the sub-frame 8-3 (SF8-3), and the sub-frame 8-4 (SF8-4). Each of the sub-frames is assigned a light emitting period required for the representation of grayscales, and the light emitting period corresponding to each of the sub-frames in the bottom row of a table of FIG. 7 is shown. The arrangement of weight values of sub-frames arranged as shown in FIG. 7 can be referred to as a first sub-frame arrangement method.

FIG. 8 shows a sub-frame configuring one frame in a display device according to an exemplary embodiment of the present invention, that is, an example of a driving method.

The sub-frames according to the second driving method of the embodiment of the present invention shown in FIG. 8 are arranged in a descending order from the sub-frame 8-4 (SF8-4) as a start to the sub-frame 1 (SF1), the sub-frame 8-4 (SF8-4), the sub-frame 8-3 (SF8-3), the sub-frame 8-2 (SF8-2), the sub-frame 8-1 (SF8-1), the sub-frame 7-2 (SF7-2), the sub-frame 7-1 (SF7-1), the sub-frame 6 (SF6), the sub-frame 5 (SF5), the sub-frame 4 (SF4), the sub-frame 3 (SF3), the sub-frame 2 (SF2), and the sub-frame 1 (SF1). Each of the sub-frames is assigned a light emitting period required for the representation of grayscales, and the light emitting period corresponding to each of the sub-frames in the bottom row of a table of FIG. 8 is shown. The arrangement of weight values of sub-frames arranged as shown in FIG. 8 can be referred to as a second sub-frame arrangement method.

Figure 9:
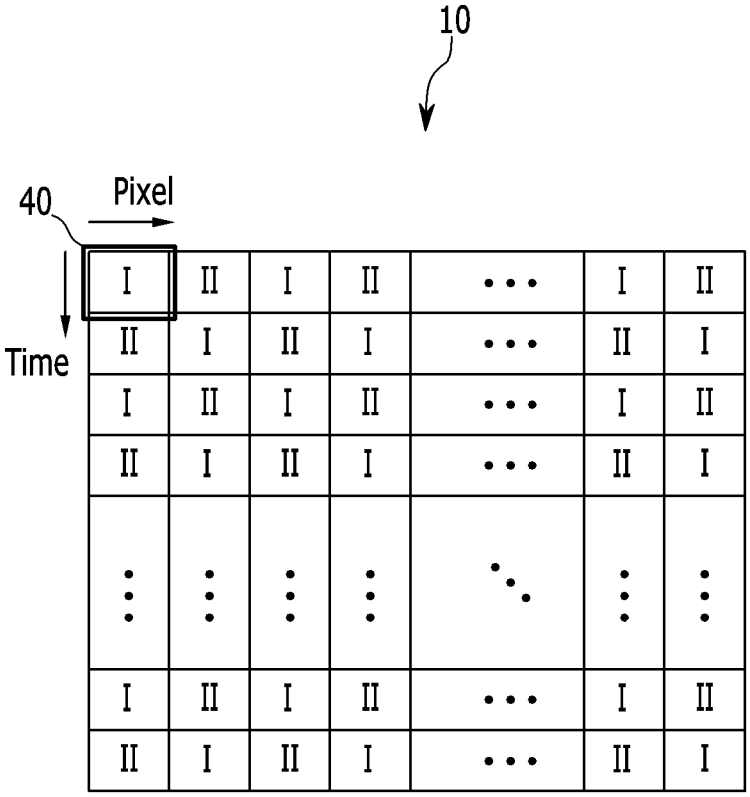
FIG. 9 shows a driving method applicable to each pixel of one frame of a display according to an exemplary embodiment of the present invention.

FIG. 9 shows a driving method applicable to each pixel of one frame of a display according to an exemplary embodiment of the present invention.

In FIG. 9, "I" represents the first driving method of FIG. 7, and "II" indicates the second driving method of FIG. 8. As shown in FIG. 9, the respective pixels 40 are set to be driven by driving methods that are different from those of their adjacent pixels. Herein, adjacent pixels of one pixel are pixels disposed next to the one pixel. In detail, when the first driving method (I) is set to a predetermined pixel 40, the second driving method (II) is set to the adjacent pixels of the pixel 40. The adjacent pixels are provided to the top, bottom, left, and right of the predetermined pixel 40. On the contrary, when the second driving method (II) is set to a predetermined pixel 40, the first driving method (I) is set to the adjacent pixels of the pixel 40, which are provided to the top, bottom, left, and right of the predetermined pixel 40.

The dynamic false contour phenomenon can be minimized by the driving method shown in FIG. 9, which will now be described in detail.

Figure 10:
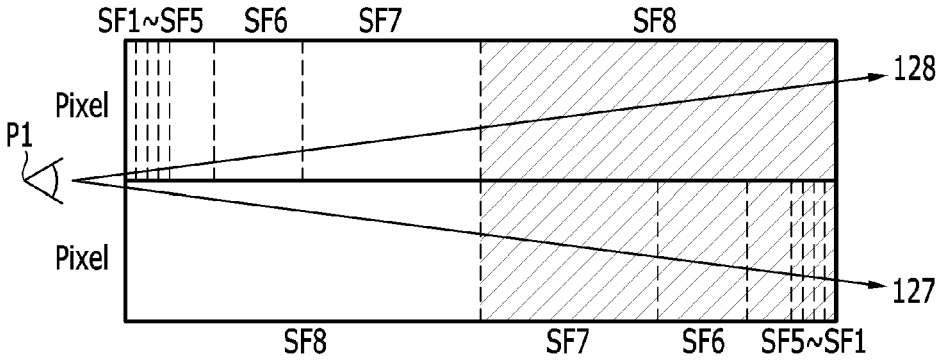
FIG. 10 shows a grayscale viewable by a viewer when a display device is driven by a driving method of FIG. 9 and there is a still image.

FIG. 10 shows a grayscale viewable by a viewer when a display device is driven by a driving method of FIG. 9 and there is a still image.

As shown in FIG. 10, for example, the gray level 127 and the gray level 128 are expressed by adjacent pixels. The sub-frame caused by the first driving method is applied to the pixel (upper pixel) for expressing the gray level 128, and the sub-frame caused by the second driving method is applied to the pixel (lower pixel) for expressing the gray level 127. The image is a still image. In this case, the viewer, at the position P1, sees the gray level 127 and the gray level 128. In this case, the dynamic false contour phenomenon may not occur.

Figure 11:
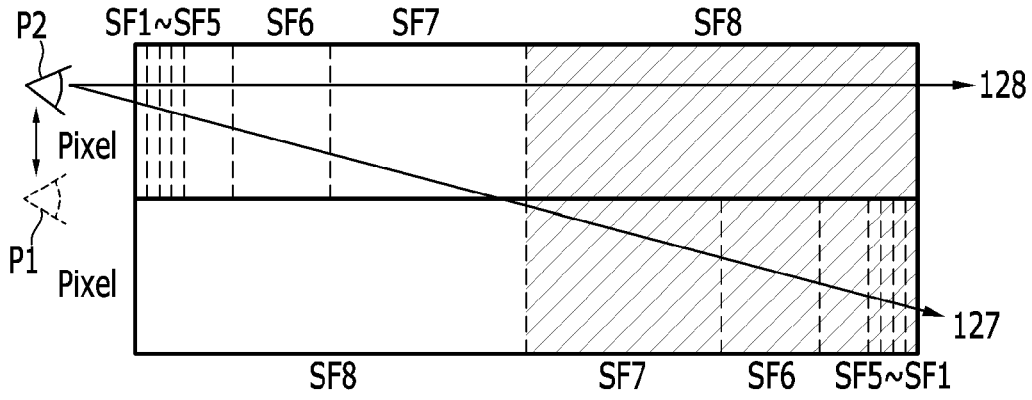
FIG. 11 shows a grayscale viewable by a viewer when a display device is driven by a driving method of FIG. 9 and an image moves.

FIG. 11 shows a grayscale viewable by a viewer when a display device is driven by a driving method of FIG. 9 and an image moves.

As shown in FIG. 11, for example, the gray level 127 and the gray level 128 are expressed by adjacent pixels. The sub-frame caused by the first driving method is applied to the pixel (upper pixel) for expressing the gray level 128, and the sub-frame caused by the second driving method is applied to the pixel (lower pixel) for expressing the gray level 127. And the image moves from top to bottom of the drawing with respect to the eye of the viewer, in other words, when the eye of the viewer moves from bottom (position P1) to top (position P2) with respect to the displaying screen, the eye of the viewer sees the gray level 127 and the gray level 128. In this case, the dynamic false contour phenomenon may not occur.

Figure 12:
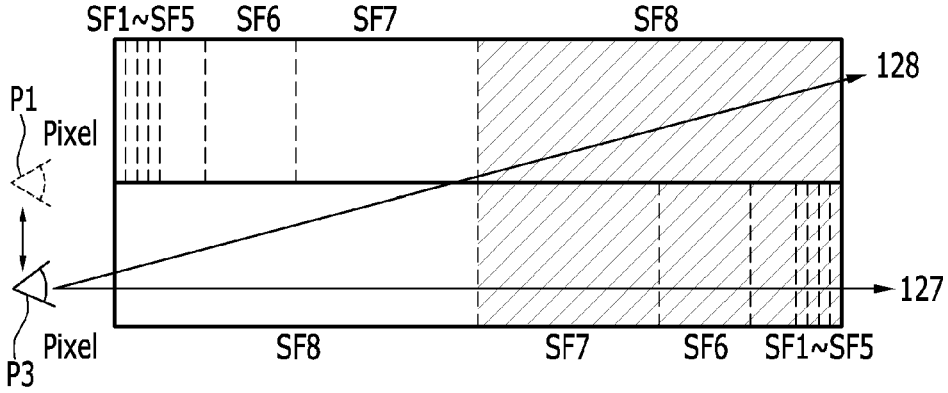
FIG. 12 shows a grayscale for expressing an image viewable by a viewer in an opposite direction of the direction of FIG. 11 when a display device is driven by a driving method of FIG. 9.

FIG. 12 shows a grayscale for expressing an image viewable by a viewer in an opposite direction of the direction of FIG. 11 when a display device is driven by a driving method of FIG. 9.

As shown in FIG. 12, for example, the gray level 127 and the gray level 128 are expressed by adjacent pixels. The sub-frame caused by the first driving method is applied to the pixel (upper pixel) for expressing the gray level 128, and the sub-frame caused by the second driving method is applied to the pixel (lower pixel) for expressing the gray level 127. The image is a still image. When the eye of the viewer moves from top (position P1) to bottom (position P3) with respect to the displaying screen, the eye of the viewer sees the gray level 127 and the gray level 128. In this case, the dynamic false contour phenomenon may not occur.

However, when the display device is driven according to the driving method of FIG. 9, a bright stripe and a dark stripe caused by superimposition can be generated according to the grayscale to be expressed. That is, the dynamic false contour phenomenon, even though reduced, may occur in the driving method of FIG. 9. A driving method for further reducing generation of the dynamic false contour phenomenon in a like manner of the driving method of FIG. 9 for applying different driving methods to the adjacent pixels will now be described in detail.

Figure 13:
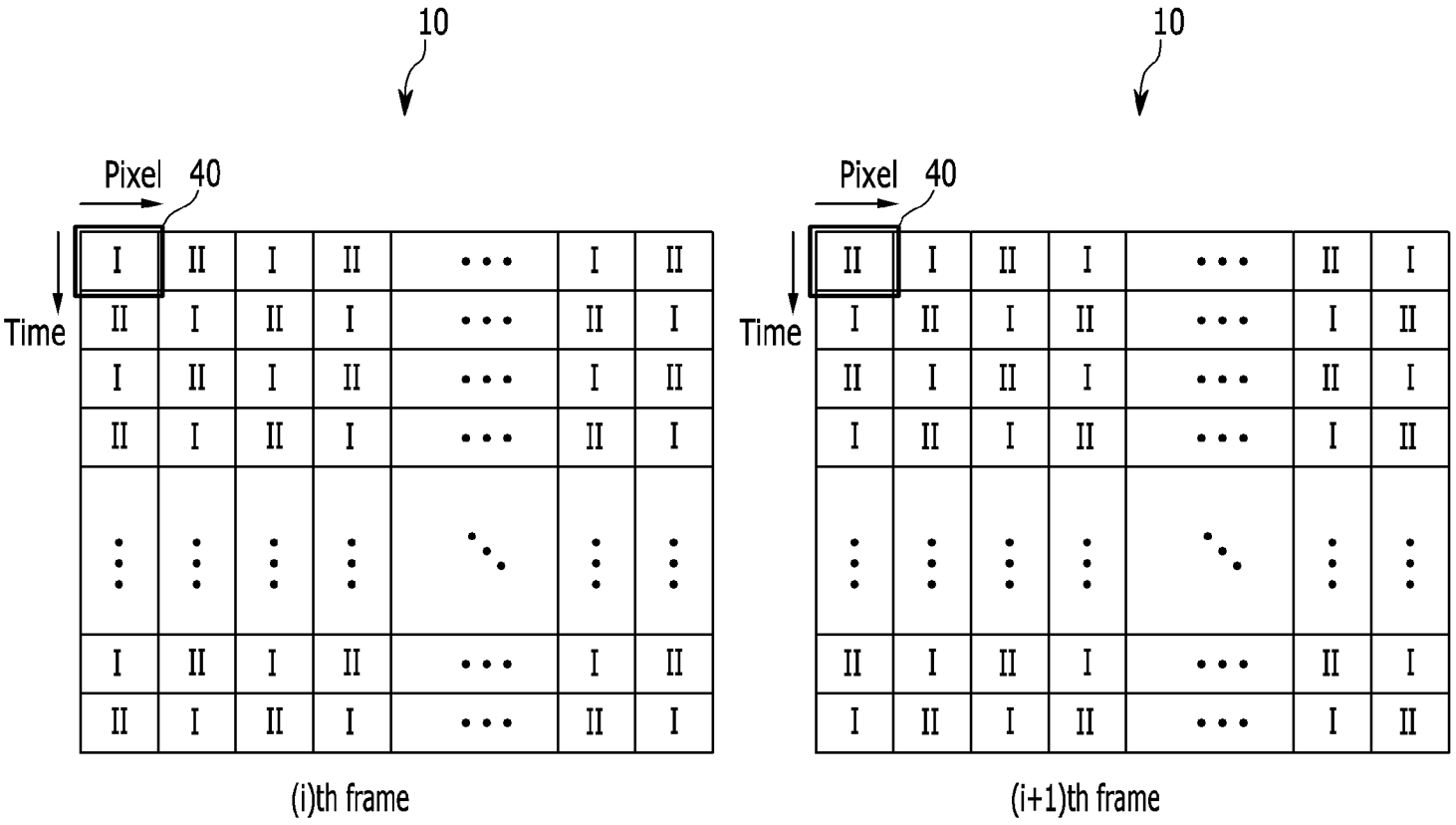
FIG. 13 shows a driving method applicable to each pixel of two adjacent frames of a display according to an exemplary embodiment of the present invention.

FIG. 13 shows a driving method applicable to each pixel of two adjacent frames of a display according to an exemplary embodiment of the present invention.

In a like manner of FIG. 9, in FIG. 13, "I" represents the first driving method of FIG. 7, and "II" indicates the second driving method of FIG. 8. As shown in FIG. 13, the respective pixels 40, when the i-th frame is applied, are driven by different driving methods from their adjacent pixels in the same manner as shown in FIG. 9. In detail, the first driving method (I) is applied to a predetermined pixel 40 at the i-th frame, and the second driving method (II) is applied to the adjacent pixels of the pixel 40, which are provided to the top, bottom, left, and right of the predetermined pixel 40. If the second driving method (II) is applied to the predetermined pixel 40 at the i-th frame, the first driving method (I) is applied to the adjacent pixels of the pixel 40, which are provided to the top, bottom, left, and right of the predetermined pixel 40.

When the next frame, which is (i+1)-th frame, is applied, pixels 40 at the (i+1)-th frame are driven by a different driving method from the adjacent pixels in the same manner as shown in FIG. 9. However, the driving method for the pixel 40 at (i+1)-th frame is different from the driving method for the pixel 40 at i-th frame. As shown in FIG. 13, the second driving method (II) is applied to the pixel 40 at (i+1)-th frame, while the first driving method (I) is applied to the pixel 40 at i-th frame. When the second driving method (II) is applied to a predetermined pixel 40 of the (i+1)th frame, the first driving method (I) is applied to the adjacent pixels 40 that are provided to the top, bottom, left, and right of the predetermined pixel 40. On the contrary, when the first driving method (I) is applied to the predetermined pixel 40 of the (i+1)th frame, the second driving method (II) is applied to the adjacent pixels 40 that are provided to the top, bottom, left, and right of the predetermined pixel 40.

In FIG. 13, when the i-th frame and the (i+1)th frame are compared, it is found that different driving methods are applied to the pixels 40 that are provided at the same position of the i-th frame and the (i+1)th frame. For example, when the first driving method (I) is set to the first pixel 40 of the i-th frame, the second driving method (II) is set to the first pixel 40 of the (i+1)th frame. On the contrary, when the second driving method (II) is set to the first pixel 40 of the i-th frame, the first driving method (I) is set to the first pixel 40 of the (i+1)th frame.

Accordingly, when the dynamic false contour phenomenon is generated at the predetermined pixel, it can be offset with the dynamic false contour phenomenon occurring at the same pixel of the next frame.

In detail, the dynamic false contour phenomenon with a bright stripe pattern may occur at a predetermined pixel and a dynamic false contour phenomenon with a dark stripe pattern may then occur at the same pixel in the next frame.

On the contrary, the dynamic false contour phenomenon with a dark stripe pattern may occur at a predetermined pixel and a dynamic false contour phenomenon with a bright stripe pattern may then occur at the same pixel in the next frame.

The dynamic false contour phenomenon with a dark (or bright) stripe pattern occurring at the predetermined pixel and the dynamic false contour phenomenon with a bright (or dark) stripe pattern occurring at the same pixel in the next frame may be offset. That is, the dynamic false contour phenomenon according to the driving method of FIG. 13 may not occur compared to the driving method of FIG. 9.

Figure 14:
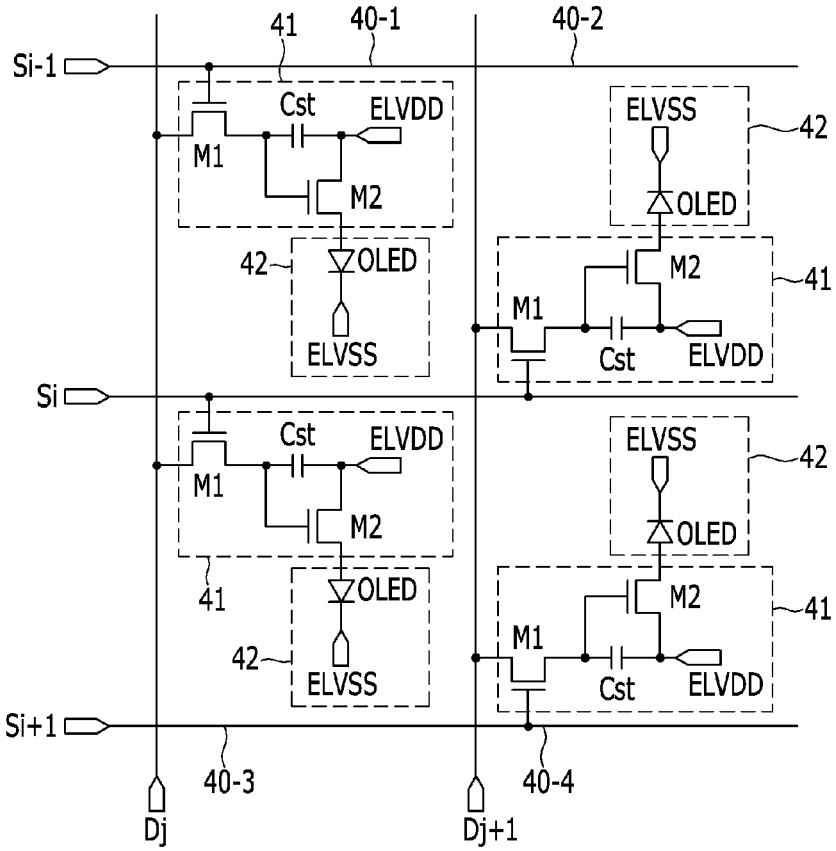
FIG. 14 shows a disposal of a pixel driver and a light emitter in a pixel of a display of a display device according to an exemplary embodiment of the present invention for applying different driving methods to adjacent pixels shown in FIG. 9.

FIG. 14 shows a disposal of a pixel driver 41 and a light emitter 42 in a pixel 40 of a display 10 of a display device according to an exemplary embodiment of the present invention for applying different driving methods to adjacent pixels shown in FIG. 9.

As shown in FIG. 14, the pixel driver 41 and the light emitter 42 of the first pixel 40-1 and the second pixel 40-2 are disposed upside down. That is, the pixel driver 41 is provided at the top of the drawing and the light emitter 42 is provided at the bottom thereof in the first pixel 40-1, and the pixel driver 41 is provided at the bottom of the drawing and the light emitter 42 is provided at the top thereof in the second pixel 40-2.

In detail, the switching transistor (M1) of the first pixel 40-1 is connected to the (i−1)th scan line (Si−1), and the switching transistor (M1) of the second pixel 40-2 is connected to the i-th scan line (Si). Also, the switching transistor (M1) of the third pixel 40-3 is connected to the i-th scan line (Si), and the switching transistor (M1) of the fourth pixel 40-4 is connected to the (i+1)th scan line (Si+1).

That is, when the switching transistor included by a predetermined pixel from among a plurality of pixels is connected to a predetermined scan line from among a plurality of scan lines, the switching transistor included by the adjacent pixels that are provided to the top, bottom, left, and right of the predetermined pixel is connected to a scan line that is adjacent to the predetermined scan line.

Further, in the case of FIG. 14, the first driving method (I) of FIG. 7 is applied to the pixels connected to the (i−1)th scan line (Si−1), the second driving method (II) of FIG. 8 is applied to the pixels connected to the i-th scan line (Si), and the second driving method (II) of FIG. 8 is applied to the pixels connected to the (i+1)th scan line (Si+1). In addition, the second driving method (II) of FIG. 8 is applied to the pixels connected to the (i−1)th scan line (Si-1), the first driving method (I) of FIG. 7 is applied to the pixels connected to the i-th scan line (Si), and the first driving method (I) of FIG. 7 is applied to the pixels connected to the (i+1)th scan line (Si+1). In other words, different driving methods are applied to the adjacent scan lines.

By the above-noted method, as shown in FIG. 9, the respective pixels 40 can be driven by the driving methods that are different from those of the adjacent pixels 40. That is, when the first driving method (I) is set to the predetermined pixel 40, the second driving method (II) can be set to the adjacent pixels 40 that are provided to the top, bottom, left, and right of the predetermined pixel 40, and when the second driving method (II) is set, the first driving method (I) can be set to the adjacent pixels 40 that are provided to the top, bottom, left, and right of the predetermined pixel 40.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

Also, the material of respective constituent elements described in the specification can be easily selected and substituted from various materials by a person of ordinary skill in the art.

Further, a person of ordinary skill in the art can omit part of the constituent elements described in the specification without deterioration of performance or can add constituent elements for better performance. In addition, a person of ordinary skill in the art can change the specification depending on the process conditions or equipment. Hence, the range of the present invention is to be determined by the claims and equivalents.

What is claimed is:

1. A display device, comprising:

a display panel including a plurality of pixels; and a timing controller for determining a driving method that includes a first sub-frame arrangement method and a second sub-frame arrangement method, an arrangement of all weight values of a plurality of sub-frames of the second sub-frame arrangement method being given in an opposite order from an arrangement of all weight values of a plurality of sub-frames of the first sub-frame arrangement method, the timing controller applying the first sub-frame arrangement method to a first pixel among the pixels at a time period, the timing controller applying the second sub-frame arrangement method to a second pixel that is disposed next to the first pixel at the time period, the first pixel being connected to a first scan line, the second pixel being connected to a second scan line, wherein the timing controller applies the second sub-frame arrangement method to the first pixel among the pixels at another time period, the timing controller applies the first sub-frame arrangement method to the second pixel at said another time period, the timing controller setting a driving method of the first pixel at a predetermined frame as the first sub-frame arrangement method, the timing controller setting a driving method of the first pixel at a frame that follows the predetermined frame as the second sub-frame arrangement method, the weight values of the plurality of the sub-frames of the first sub-frame arrangement method being arranged in an order of a grayscale of 1, a grayscale of 2, a grayscale of 4, a grayscale of 8, a grayscale of 16, and a multiple grayscales of 32, the weight values of the plurality of the sub-frames of the second sub-frame arrangement method being arranged in an order of the multiple grayscales of 32, the grayscale of 16, the grayscale of 8, the grayscale of 4, the grayscale of 2, and the grayscale of 1.

2. The display device of claim 1, wherein the timing controller sets a driving method of the first pixel at a predetermined frame as the second sub-frame arrangement method, and sets a driving method of the first pixel at a frame that follows the predetermined frame as the first sub-frame arrangement method.

3. A display device, comprising:

a scan driver for transmitting a plurality of scan signals to a plurality of scan lines;

a data driver for transmitting a plurality of data signals to a plurality of data lines;

a display panel including a plurality of pixels; and a timing controller for controlling the scan driver and determining a driving method applicable to the plurality of pixels connected to a predetermined scan line among the plurality of scan lines, wherein the driving method includes a first sub-frame arrangement method and a second sub-frame arrangement method, an arrangement of all weight values of a plurality of sub-frames of the second sub-frame arrangement method is given in an opposite order from an arrangement of all weight values of a plurality of sub-frames of the first sub-frame arrangement method, the timing controller applies the first sub-frame arrangement method to a first scan line among the scan lines and the second sub-frame arrangement method to a second scan line that is disposed next to the first scan line, the plurality of pixels include a switching transistor including a gate electrode connected to a corresponding scan line among the plurality of scan lines and a source electrode connected to a corresponding data line among a plurality of data lines, and when the switching transistor included by a first pixel among the plurality of pixels is connected to a first scan line among the plurality of scan lines, the switching transistor included by a second pixel that is disposed next to the first pixel is connected to a second scan line that is disposed next to the predetermined scan line, the first pixel being connected to a first scan line, the second pixel being connected to a second scan line, the timing controller setting a driving method of the first pixel at a predetermined frame as the second sub-frame arrangement method, the timing controller setting a driving method of the first pixel at a frame that follows the predetermined frame as the first sub-frame arrangement method, the weight values of the plurality of the sub-frames of the first sub-frame arrangement method being arranged in an order of a grayscale of 1, a grayscale of 2, a grayscale of 4, a grayscale of 8, a grayscale of 16, and a multiple grayscales of 32, the weight values of the plurality of the sub-frames of the second sub-frame arrangement method being arranged in an order of the multiple grayscales of 32, the grayscale of 16, the grayscale of 8, the grayscale of 4, the grayscale of 2, and the grayscale of 1.

4. The display device of claim 3, wherein the timing controller sets a driving method of the first pixel at a predetermined frame as the first sub-frame arrangement method, and sets a driving method of the first pixel at a frame that follows the predetermined frame as the second sub-frame arrangement method.

5. The display device of claim 3, wherein the plurality of pixels comprises:

a pixel driver including the switching transistor, a driving transistor, and a storage capacitor; and an organic light emitting diode (OLED), wherein positions of the pixel driver and the organic light emitting diode (OLED) among adjacent pixels from among the plurality of pixel are reversed.

6. A display device, comprising:

a display panel including a plurality of pixels; and a timing controller for determining a driving method that includes a first sub-frame arrangement method and a second sub-frame arrangement method, an arrangement of all weight values of a plurality of sub-frames of the second sub-frame arrangement method being in an opposite order from an arrangement of all weight values of a plurality of sub-frames of the first sub-frame arrangement method, the timing controller applying the first sub-frame arrangement method to a first pixel at a predetermined frame, the timing controller applying the second sub-frame arrangement method to a second pixel at the predetermined frame, the second pixel being disposed next to the first pixel, the first pixel being connected to a first scan line, the second pixel being connected to a second scan line, the timing controller applying the second sub-frame arrangement method to the first pixel at anther frame that sequentially follows the predetermined frame, the timing controller applying the first sub-frame arrangement method to the second pixel at said anther frame, the weight values of the plurality of the sub-frames of the first sub-frame arrangement method being arranged in an order of a grayscale of 1, a grayscale of 2, a grayscale of 4, a grayscale of 8, a grayscale of 16, and a multiple grayscales of 32, the weight values of the plurality of the sub-frames of the second sub-frame arrangement method being arranged in an order of the multiple grayscales of 32, the grayscale of 16, the grayscale of 8, the grayscale of 4, the grayscale of 2, and the grayscale of 1.

7. The display device of claim 6, wherein the timing controller applies the first sub-frame arrangement method to a third pixel at the predetermined frame, the third pixel being disposed next to the second pixel.

8. The display device of claim 6, wherein the timing controller applies the second sub-frame arrangement method to a third pixel at said another frame, the third pixel being disposed next to the second pixel.

* * * * *